US005827628A

United States Patent [19]

Shin et al.

[11] Patent Number: 5,827,628

[45] Date of Patent: Oct. 27, 1998

[54] METHOD OF ELECTROGRAPHICALLY MANUFACTURING A LUMINESCENT SCREEN ASSEMBLY FOR A CRT AND CRT COMPRISING A LUMINESCENT SCREEN ASSEMBLY MANUFACTURING BY THE METHOD

[75] Inventors: Dong Ky Shin; Bok Soo Lee; Sang Youl Yoon, all of Kyungsangbuk-do, Rep. of Korea

[73] Assignee: Orion Electric Co., Ltd., Kyungsangbuk-do, Rep. of Korea

[21] Appl. No.: 814,255

[22] Filed: Mar. 11, 1997

[51] Int. Cl.[6] ..... G03C 5/00

[52] U.S. Cl. ..... 430/28; 430/23

[58] Field of Search ..... 430/23, 25, 26, 430/28

[56] References Cited

U.S. PATENT DOCUMENTS

| | | | |
|---|---|---|---|
| 3,956,526 | 5/1976 | Ohshima et al. | 427/73 |
| 5,229,234 | 7/1993 | Riddle et al. | 430/28 |
| 5,240,798 | 8/1993 | Ebemann et al. | 430/23 |
| 5,455,133 | 10/1995 | Gorog et al. | 430/23 |
| 5,501,928 | 3/1996 | Datta et al. | 430/23 |
| 5,552,253 | 9/1996 | Kouacs et al. | 430/57 |

FOREIGN PATENT DOCUMENTS

| | | |
|---|---|---|
| 0064319 | 11/1982 | European Pat. Off. . |
| 0081329 | 6/1983 | European Pat. Off. . |
| 0378911 | 7/1990 | European Pat. Off. . |

*Primary Examiner*—John Goodrow
*Attorney, Agent, or Firm*—Notaro & Michalos P.C.

[57] ABSTRACT

The method of electrophotographically manufacturing a screen on an interior surface of a faceplate for a CRT, according to the present invention comprises the steps of first-coating the faceplate with a volatilizable conductive layer, second-coating the conductive layer with the first photoconductive layer including a dye sensitive to ultraviolet rays, third-coating the ultraviolet-photoconductive layer with a second photoconductive layer including a dye sensitive to visible light, charging the whole area of the second photoconductive layer by exposing the whole surface of the second photoconductive layer to visible light while applying a suitable DC voltage between the conductive layer and the second photoconductive layer, and exposing selected areas of said first photoconductive layer to ultraviolet rays through a shadow mask to discharge the charge from the selected areas of the first photoconductive layer. Then, in developing a uniform density of the screen structure material is obtained.

8 Claims, 5 Drawing Sheets

34
32
18

36
34
32
18

38
40
16a
16
34
32
18

18
32
34
42

21
34
32
18

136
134
132
18
Sa
Sb
138
140
16
16a
142
144a
144b
146
148
COMPRESSED AIR
ELECTRIC POWER
R,G,B (21)

METHOD OF ELECTROGRAPHICALLY MANUFACTURING A LUMINESCENT SCREEN ASSEMBLY FOR A CRT AND CRT COMPRISING A LUMINESCENT SCREEN ASSEMBLY MANUFACTURING BY THE METHOD

FIELD OF THE INVENTION

The present invention relates to a method of electrophotographically manufacturing a viewing screen for a cathode-ray tube(CRT), and more particularly to layers consisting of a conductive layer and two different photoconductive layers to obtain uniform charging over the whole surface of one photoconductive layer during a charge step in the electrophotographic screening(EPS) process.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14 and a shadow mask 16 removably mounted to a sidewall of the panel 12. A three color phosphor screen is formed on the inner surface of a display window or faceplate 18 of the panel 12. The electron gun 11 generates three electron beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, as shown in FIG. 2, comprises an array of three phosphor elements R, G and B of three different emission colors arranged in a cyclic order of a predetermined structure of multiple-stripe or multiple-dot shape and a matrix of light-absorptive material surrounding the phosphor elements R, G and B.

A thin film of aluminum 22 overlies the screen 20 in order to provide a means for applying the uniform potential applied through the anode button 15 to the screen 20, increase the brightness of the phosphor screen and prevent from degrading ions in the phosphor screen and decreasing the potential of the phosphor screen. And also, a film of resin such as lacquer(not shown) may be applied between the aluminum thin film 22 and the phosphor screen to enhance the flatness and reflectivity of the aluminum thin film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby necessitating a high cost in manufacturing the phosphor screen. And also, it discharges a large quantity of effluent such as waste water, phosphor elements, 6th chrome sensitizer, etc., with the use of a large quantity of clean water.

To solve or alleviate the above problems, the improved process of eletrophotographically manufacturing the screen utilizing dry-powdered phosphor particles is developed. U.S. Pat. No. 4,921,767, issued to Datta at al. on May 1, 1990, describes one method of electrophotographically manufacturing the phosphor screen assembly using dry-powdered phosphor particles through the repetition of a series of steps represented in FIGS. 3A to 3E and in the block diagram of FIG. 4, as is briefly explained in the following.

A conductive layer 32, as shown in FIG. 3A, is formed by conventionally coating the inner surface of the viewing faceplate 18 with a suitable conductive solution comprising an electrically conductive material which provides an electrode for an overlying photoconductive layer 34. The conductive layer 32 can be an inorganic conductive material such as tin oxide or indium oxide, or their mixture or, preferably, a volatilizable organic conductive material consisting of a polyelectrolyte commercially known as polybrene (1,5-dimethy-1,5-diaza-undecamethylene polymethobromide, hexadimethrine bromide), available from Aldrich Chemical Co., Milwaukee Wis., or another quaternary ammonium salt. The polybrene is conventionally applied to the inner surface of the viewing faceplate 18 in an aqueous solution containing about 10 percent by weight of propanol and about 10 percent by weight of a water soluable, adhesion promoting polymer such as poly (vinyl alcohol), polyacrylic acid, certain polyamides and the like, and the coated solution is dried to form the conductive layer 32 having a thickness from about 1 to 2 microns and a surface resistivity of less than about 108 ohms per square unit. The photoconductive layer 34 is formed by coating the conductive layer 32 with a photoconductive solution comprising a volatilizable organic polymeric material, a suitable photoconductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate. The suitable dyes, which are sensitive to light in the visible spectrum, preferably from about 400 to 700 nm, include crystal violet, chloridine blue, rhodamine EG and the like. This dye is typically present in the photoconductive composition in from about 0.1 to 0.4% by weight. The solvent for the photoconductive composition is an organic such as chlorobenzene or cyclopentanone and the like which will produce as little cross contamination as possible between the layers 32 and 34. The photoconductive solution is conventionally applied to the conductive layer 32, as by spin coating, and dried to form a layer having a thickness from about 2 to 6 microns. These coating steps are represented as steps S1 and S2 in FIG. 4.

FIG. 3B schematically illustrates a charging step, wherein the photoconductive layer 34 overlying the conductive layer 32 is positively charged in a dark environment by a conventional positive corona discharger 36, which moves across the layer 34 and charges it within the range of +200 to +700 volts. The charging step is represented as steps S3, S7 and S11 in FIG. 4.

FIG. 3C schematically shows an exposure step, wherein the shadow mask 16 is inserted in the panel 12 and the charged photoconductor is exposed through a lens system 40 and the shadow mask 16, to the light from a xenon flash lamp 38 disposed at one position within a conventional three-in-one lighthouse. Then, the positive charges of the exposed areas are discharged through the grounded conductive layer 132 and the charges of the unexposed areas remain in the photoconductive layer 134, thus establishing a latent charge image in a predetermined array structure. Three exposures are required for forming a light-absorptive matrix with three different incident angles, respectively. The exposure step is represented as steps S4, S8 and S12 in FIG. 4.

FIG. 3D schematically represents a developing step, wherein the shadow mask 16 is removed from the panel 12 and the positively or negatively charged, dry-powdered particles are expelled from the developer and deposited to one of the charged, unexposed areas and the discharged, exposed areas depending on the polarity of the charged particles due to electrical attraction or repulsion, thus one of the two areas is developed in a predetermined array pattern. The deposited particles are fixed to the photoconductive layer 34 as described hereinafter. The light-absorptive material particles for directly developing the unexposed or positively charged areas are charged negatively and the phosphor particles are positively charged for reversely developing the exposed or discharged areas. The charging of the dry-powdered particles is executed by a triboelectrical charging method using surface-treated carrier beads.

The dry-powdered particles and the surface-treated carrier beads, coated with a thin film of a suitable charge-control agent, are mixed in the developer 42. The black matrix particles or phosphor particles are negatively or positively charged by the surface-treated carrier beads depending upon the suitable charge-control agent. The developing step is represented as steps S5, S9 and S13 in FIG. 4.

FIG. 3E schematically represents a fixing step, wherein infrared radiation is used to fix the deposited particles by melting or thermally bonding the polymer component of the particles 21 to the photoconductive layer 34 to form a matrix of light-absorptive material 21 or an array of three phosphor elements R, G and B in FIG. 2. The fixing step is represented as steps S6, S7 and S14 in FIG. 4.

FIG. 4 is a block diagram of the processing sequence for forming an array of three phosphor elements using the aforementioned steps. Prior to the EPS process, a panel 12 is washed with a caustic solution, rinsed with water, etched with buffered hydrofluoric acid and rinsed once again with water as is known in the art.

In steps S1 and S2, a conductive layer 32 and an overlying photoconductive layer 34 is formed as shown in FIG. 3A. In FIG. 4, the forming sequence of the matrix of light-absorptive material is omitted but can be easily understood from the above description. That is, the steps of charging, exposing, developing and fixing as to the dry-powdered, light-absorptive, surface treated black matrix particles are performed between a coating step S2 and a first charging step S3 to deposit the black matrix particles on the photoconductive layer 34. An array of three phosphor elements R, G and B are then deposited on the photoconductive layer 34 of the panel 12 on which the black matrix of light-absorptive material is deposited.

In step S3, the photoconductive layer 34 is positively charged in the manner described in FIG. 3B, and in step S4 the areas of the photoconductive layer 34 where a first phosphor particles G will be deposited are exposed in the manner described in FIG. 3C. Then, in steps S5 and S6, the first phosphor particles G are deposited and fixed on the exposed areas of the photoconductive layer 34 in the manners described in FIGS. 3D and 3E. The steps of charging, exposing, developing and fixing are repeated for a second phosphor particles B in steps S7 to S10, and also for the third phosphor particles R in steps S11 to S14.

Subsequent to the fixing of the three phosphor particles R, G and B, a spray film of lacquer is applied by conventional means to the screen structure materials in step S15 and then a thin film of aluminum is vapor deposited onto the lacquer film in step S16, as is known in the art.

In step 17, the faceplate panel 12 is baked in air at a temperature of 425 degrees centigrade, for about 30 minutes to drive off the volatilizable constituents of screen including the conductive layer 32, the photoconductive layer 34, the solvents present in both the screen structure materials and in the filming lacquer.

As an alternative to the above-described "matrix first" process, U.S. Pat. No. 5,240,798 discloses a "matrix last" process, wherein the black matrix 21 is electrophotographically formed after the fixing of the three phosphor particles R, G and B. In the matrix last process, the photoconductive layer 34 is recharged positively, thereby creating electrostatic "image forces" that are weakest in the areas with overlying phosphor particles and strongest in the open areas between the overlying phosphor particles. Thus, without an exposure step, the black matrix particles can be deposited on the open areas of the photoconductive layer 34 in the developing step due to a large voltage contrast of the charge between the overlying areas and open areas, providing a matrix of greater opacity with fewer processing steps.

The resultant screen assembly manufactured by EPS process possesses high resolution, higher light output than a conventional wet processed screen, and greater color purity because of less cross-contamination of the phosphor materials.

Also, U.S. Pat. No. 5,413,885 discloses a method of electrophotographically manufacturing the CRT screen under low intensity yellow lights of 577–597 nm using a novel photoconductive layer. The photoconductive layer comprises ultraviolet-sensitive material consisting of bis dimethyl phenyl diphenyl butatriene, and one of trinitro fuorenone (TNF), ethylanthraquinone (EAQ) and their mixture.

Turning to FIG. 3B, a complicated discharge apparatus like the corona discharger 36, much time and a lot of electrical energy are required to charge the photoconductive layer 35 to a suitable potential within the range of +200 to +700 volts. Also, the whole surface of the photoconductive layer 34 should be uniformly charged to obtain a uniform density of the deposited phosphor particles in the developing step of FIG. 3D. However, it is very difficult to obtain the uniformly charged photoconductive layer 34 due to the sharp shape of charging electrode of the corona discharger 36, the difference between the curvature of the faceplate 18 and the curvature of the charging electrode, the difference in the distance between the faceplate 18 and the charging electrode, the non-uniform thickness of the photoconductive layer 34, the difference of the applied potential depending on the areas over the whole photoconductive layer 34, etc., as the electrode moves across the photoconductive layer 34.

It is an object of the present invention to provide coating layers consisting of a conductive layer and two different photoconductive layers to obtain uniform charging over the whole surface of one photoconductive layer without a corona discharger during a charging step in the electrophotographical screening(EPS) process for a CRT.

It is another object of the present invention to provide a CRT having screen structure materials formed in uniform density by manufacturing using the coating layers.

SUMMARY OF THE INVENTION

In accordance with one object of the present invention, a method of electrophotographically manufacturing a luminescent screen on an interior surface of a faceplate panel for a CRT comprises the steps of: (a) first-coating said surface of the panel with a volatilizable conductive layer; (b) second-coating said conductive layer with a volatilizable first photoconductive layer including a dye sensitive to ultraviolet rays; (c) third-coating said ultraviolet-photoconductive layer with a volatilizable second photoconductive layer including a dye sensitive to visible light; (d) establishing a substantially uniform electrostatic charge over the whole area of the inner surface of said second photoconductive layer by exposing the whole surface of said second photoconductive layer to visible light to charge said second photoconductive layer while applying a suitable DC voltage between the conductive layer and the second photoconductive layer; (e) exposing selected areas of said first photoconductive layer to ultraviolet rays through a shadow mask to discharge the charge from the selected areas of of the inner surface of the second photoconductive layer; and (f) developing one of the charged, unexposed areas and the discharged, exposed areas depending upon the polarity of the charged particles with one of charged phosphor particles and light-absorptive material particles after removing the shadow mask.

In accordance with another object of the present invention, a CRT comprises a luminescent viewing screen and means for selectively exciting areas of said screen to luminescence, wherein screen structure materials of the screen are formed in uniform density by the foregoing method.

DETAILED DESCRIPTION OF THE PREFERRED EMBODIMENT

Figures 5A, 5B, 5C, 5D, 5E:
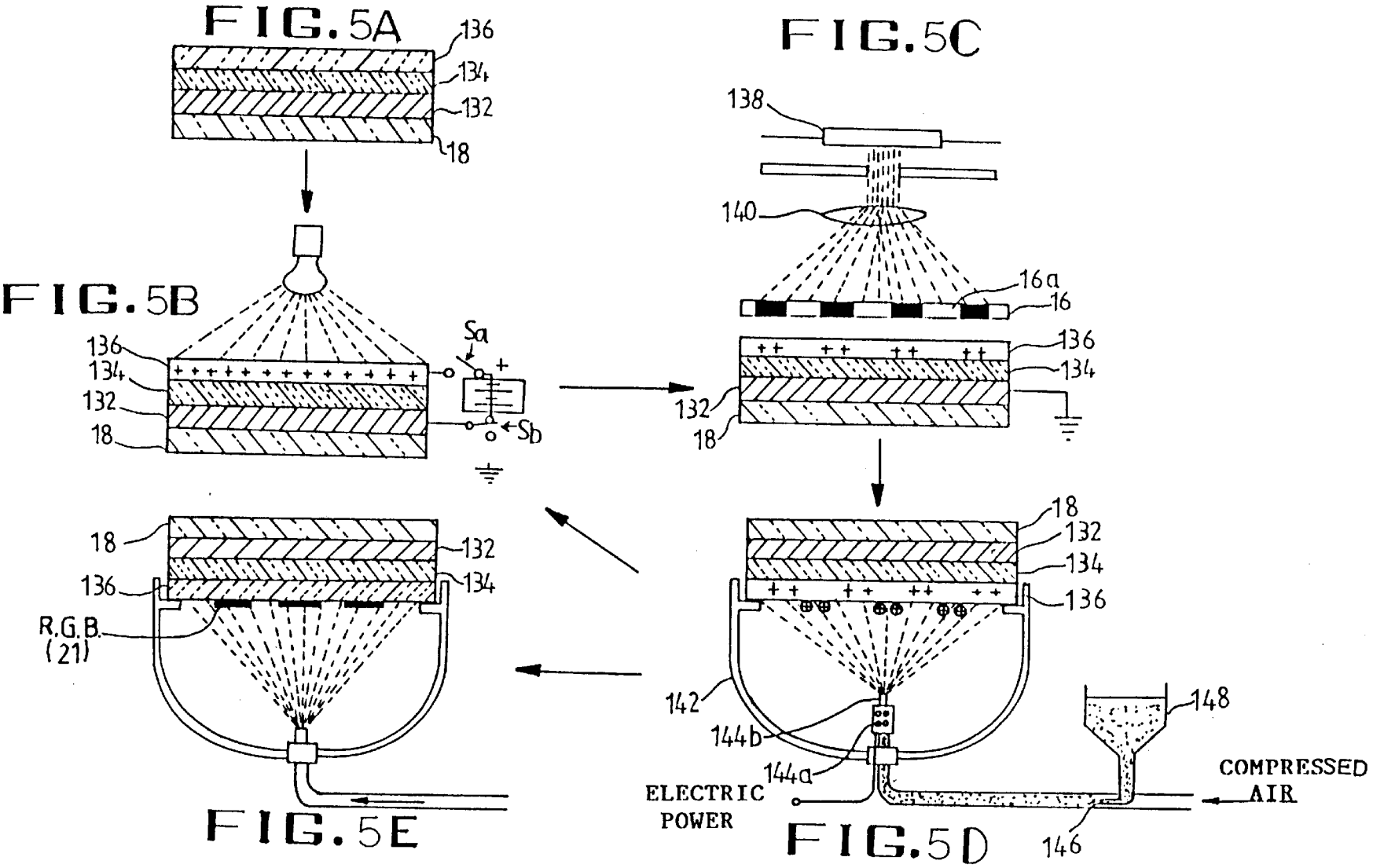
FIGS. 5A through 5E show various steps in electrophotographically manufacturing the screen assembly of the tube according to the present invention.

FIGS. 5A through 5E schematically show various steps in a novel manufacturing method in accordance with the present invention. FIG. 5A represents a coating step, showing a portion of a faceplate 18 on the inner surface of which an electrically conductive layer 132 is formed on the interior surface of the faceplate 18 and a first photoconductive layer 134 and a second photoconductive layer 136 sequentially overlies the conductive layer 132. The first photoconductive layer 134 contains photoconductive material sensitive to ultraviolet rays and the second photoconductive layer 136 contains photoconductive material sensitive to visible light. Each of the first photoconductive layer 134 and the second photoconductive layer 136 may contain photoconductive material having sensitivity in each wavelength range different from the wavelength ranges of ultraviolet rays and visible light.

The conductive layer 132 can be formed by conventionally applying a volatilizable organic conductive material consisting of about 1 to 50% of a polyelectrolyte commercially known as Catfloc-c, available from Calgon Co., Pittsburgh, Pa., to the inner surface of the faceplate 18 in an aqueous solution containing about 1 to 50 weight % of 10% poly vinyl alcohol and drying the solution, said conductive layer 132 serving as an electrode for the overlying first photoconductive layer 134. The first photoconductive layer 134 is formed by conventionally applying to the conductive layer 132 the first photoconductive solution containing ultraviolet-sensitive material and drying it. Then, the second photoconductive layer 136 is formed by conventionally applying to the first photoconductive layer 134 the second photoconductive solution containing visible-light-sensitive material and drying it.

The ultraviolet-sensitive material can consist of bis dimethyl phenyl diphenyl butatriene, and one of trinitro fuorenone(TNF), ethylanthraquinone(EAQ) and their mixture. The photoconductive solution is prepared by dissolving 0.01 to 10% by weight of bis dimethyl phenyl diphenyl butatriene and 1 to 30% by weight of polystyrene as a polymeric binder in a suitable solvent such as toluene or xylene. The second photoconductive solution is prepared by dissolving 1 to 30 weight % of poly vinyl carbazol and 0.1 to 1 weight % of ethylene violet in the remaining chlorobenzene as a solvent. The second photoconductive solution may be prepared as described in U.S. Pat. No. 4,921,767, cited above.

FIG. 5B schematically illustrates a charging step, in which the whole surface of said second photoconductive layer 136 is exposed to visible light to positively charge said first photoconductive layer 134 while applying a suitable DC voltage between the conductive layer 132 and the second photoconductive layer 136. In FIG. 5B, a positive terminal of a DC power source is connected to the second photoconductive layer 136 by closing a switch Sa and a negative terminal of the DC power source is connected to the conductive layer 132 through a switch Sb, thus said conductive layer 132 and the second photoconductive layer 136 consisting of a sort of a condenser with an insulator of the intermediate first photoconductive layer 134. In a predetermined time, the switch Sa opens and the switch Sb is changed so as to connect the conductive layer 132 to the earth. Then, the uniform positive charge remains over the whole areas of the inner surface of the second photoconductive layer 136 and the negative charge is discharged from the conductive layer 132 through the switch Sb. That is, the inner surface of the second photoconductive layer 136 is uniformly charged since the whole surface of the second photoconductive layer 136 has the same conductivity by exposing to the visible light with the same intensity of illumination over the whole surface thereof and becomes an electrode for charging the second photoconductive layer 136 to the same extent over the whole surface thereof. FIG. 5C schematically shows an exposure step. The shadow mask 16 is inserted in the panel 12 and the positively charged second photoconductive layer 136 is selectively exposed through an ultraviolet-transmissive lens system 140 and apertures or slits 16*a* of the shadow mask 16 to the ultraviolet rays, preferably including visible light, from a ultraviolet lamp 138 with each predetermined incident angle with respect to each aperture or slit 16*a*. The charges of the exposed areas of the inner surface of the second photoconductive layer 136 are discharged through the first photoconductive layer 134 and the grounded conductive layer 132, and the charges of the unexposed areas remain in the second photoconductive layer 136, thus establishing a latent charge image in a predetermined array structure. Three exposures with three different incident angles of the three electron beams, respectively are required for forming a light-absorptive matrix.

FIG. 5D diagrammatically illustrates the outline of a developing step, in which, after removing the shadow mask 16, suitably charged, dry-powdered particles such as particular color-emitting phosphor particles or light-absorptive material particles are sprayed by compressed air toward the second photoconductive layer 136 through a venturi tube 14*b* and a nozzle 144*b* from a hopper 148 and attracted to one of the charged or unexposed areas and the discharged or exposed areas depending upon the polarity of the charged particles due to electrical attraction or repulsion, thus one of the two areas is developed in a predetermined array pattern. Below the nozzle 144*b*, there is provided a discharge electrode 144*a* such as a corona discharger for charging dry-powdered particles to be sprayed in the nozzle 144*b*. The light-absorptive material particles for directly developing the unexposed, positively charged areas are negatively charged and the phosphor particles are positively charged for reversely developing the exposed, discharged areas. The charging of the dry-powdered particles may be executed by a triboelectrical charging method disclosed in U.S. Pat. No. 4,921,767 issued to Datta at al. on May 1, 1990, cited above.

FIG. 5E schematically illustrates a fixing step using a vapour swelling method. In the fixing step, the surface of the second photoconductive layer 136 containing polymers are dissolved by coming into contact with solvent vapoursuch as acetone, methyl isobutyl ketone, etc., on the surface of the developed second photoconductive layer 136, thereby said dissolved polymers fixing the dry-powdered particles deposited on the developed areas of the second photoconductive layer 136.

Figure 1:
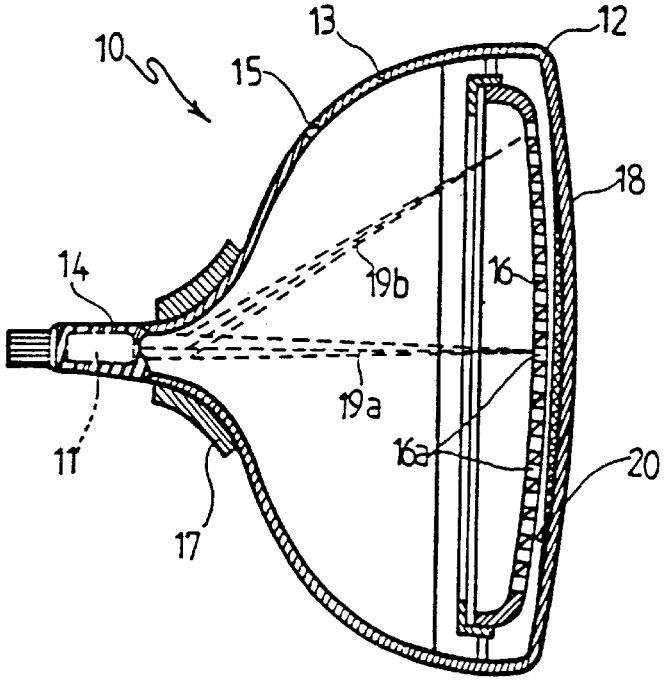
FIG. 1 is a plan view partially in axial section of a color cathode-ray tube.
Figure 2:
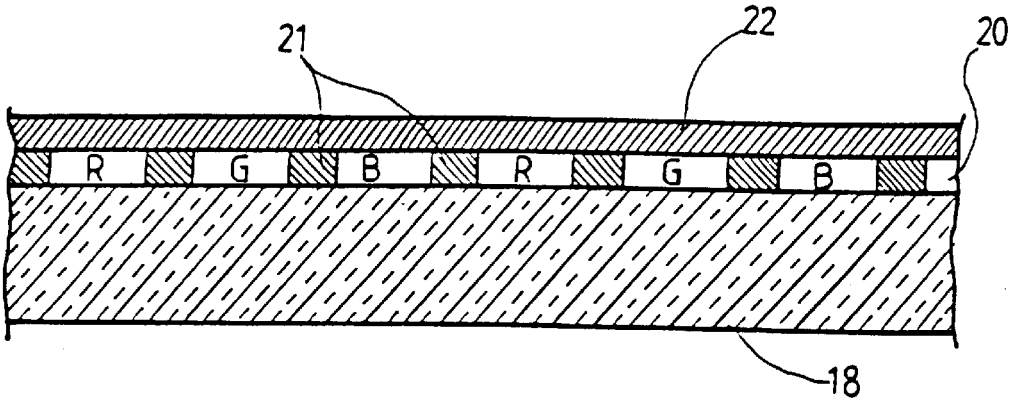
FIG. 2 is a section of a screen assembly of the tube shown in FIG.1.
Figures 3A, 3B, 3C, 3D, 3E:
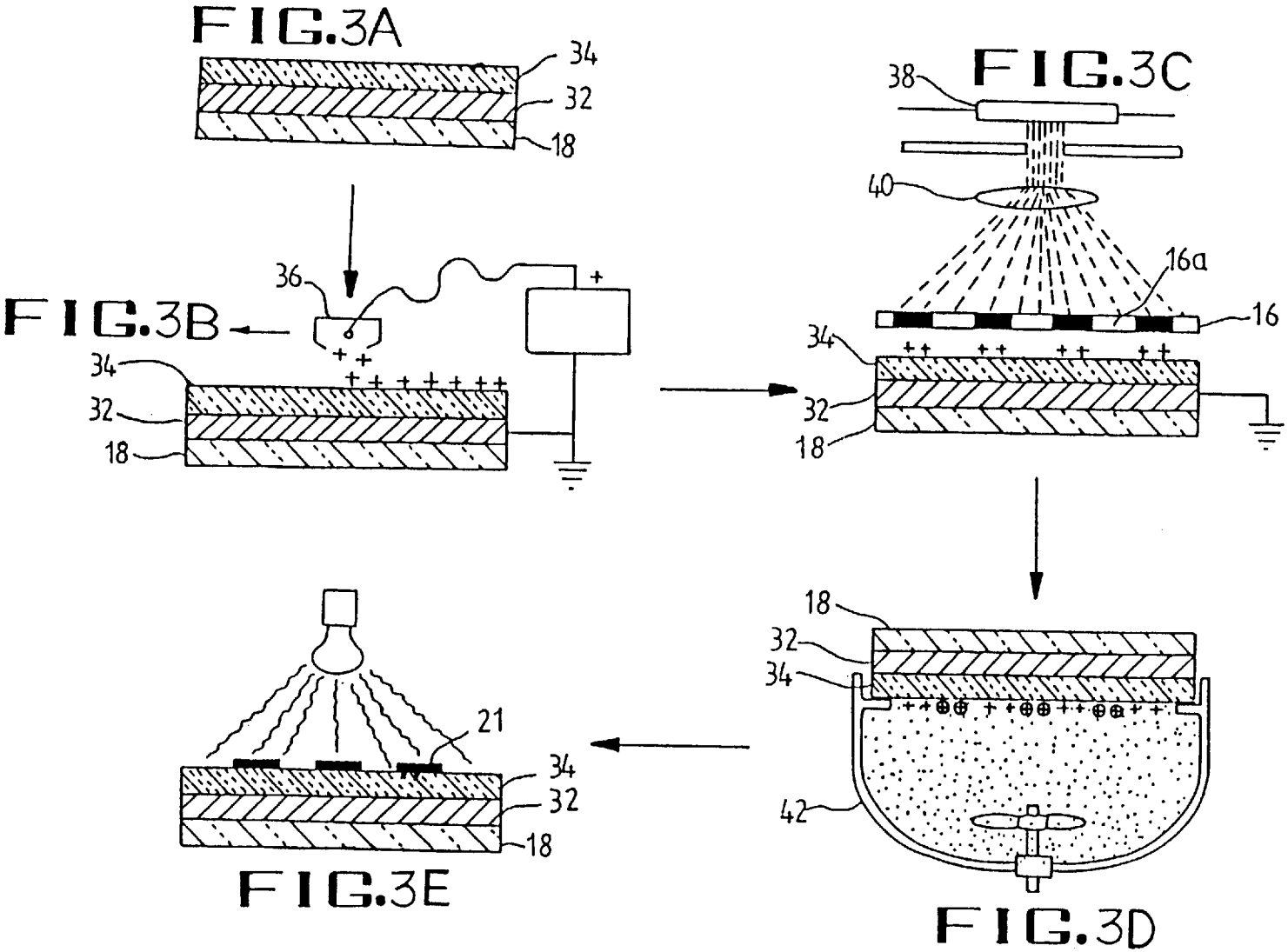
FIGS. 3A through 3E show various steps in electrophotographically manufacturing the screen assembly of the tube according to the prior art by viewing a portion of a faceplate having a conductive layer and an overlying photoconductive layer.
Figure 4:
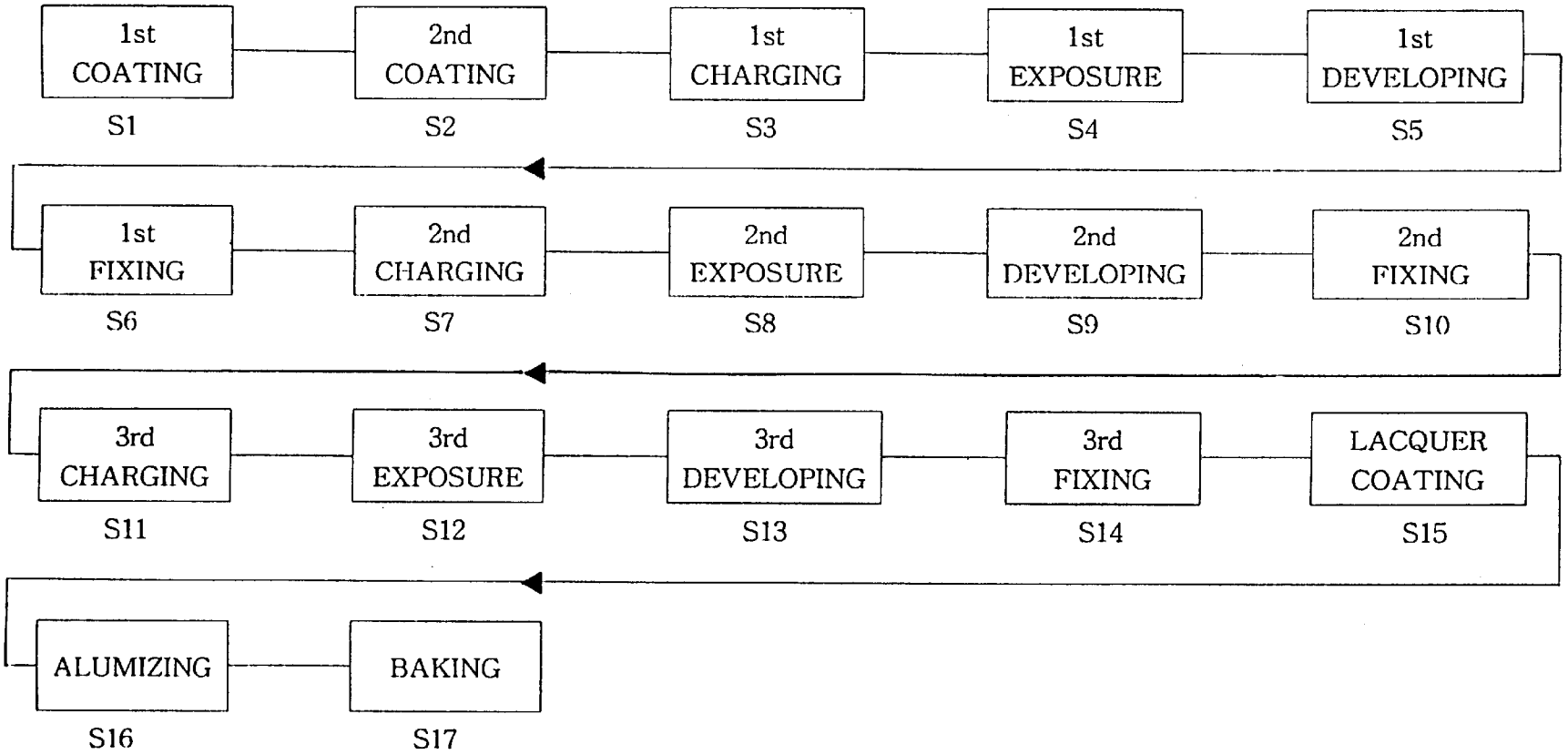
FIG. 4 is a block diagram of the processing sequence for forming an array of three phosphor elements using the steps of FIGS. 3A to 3E.
Figure 6:
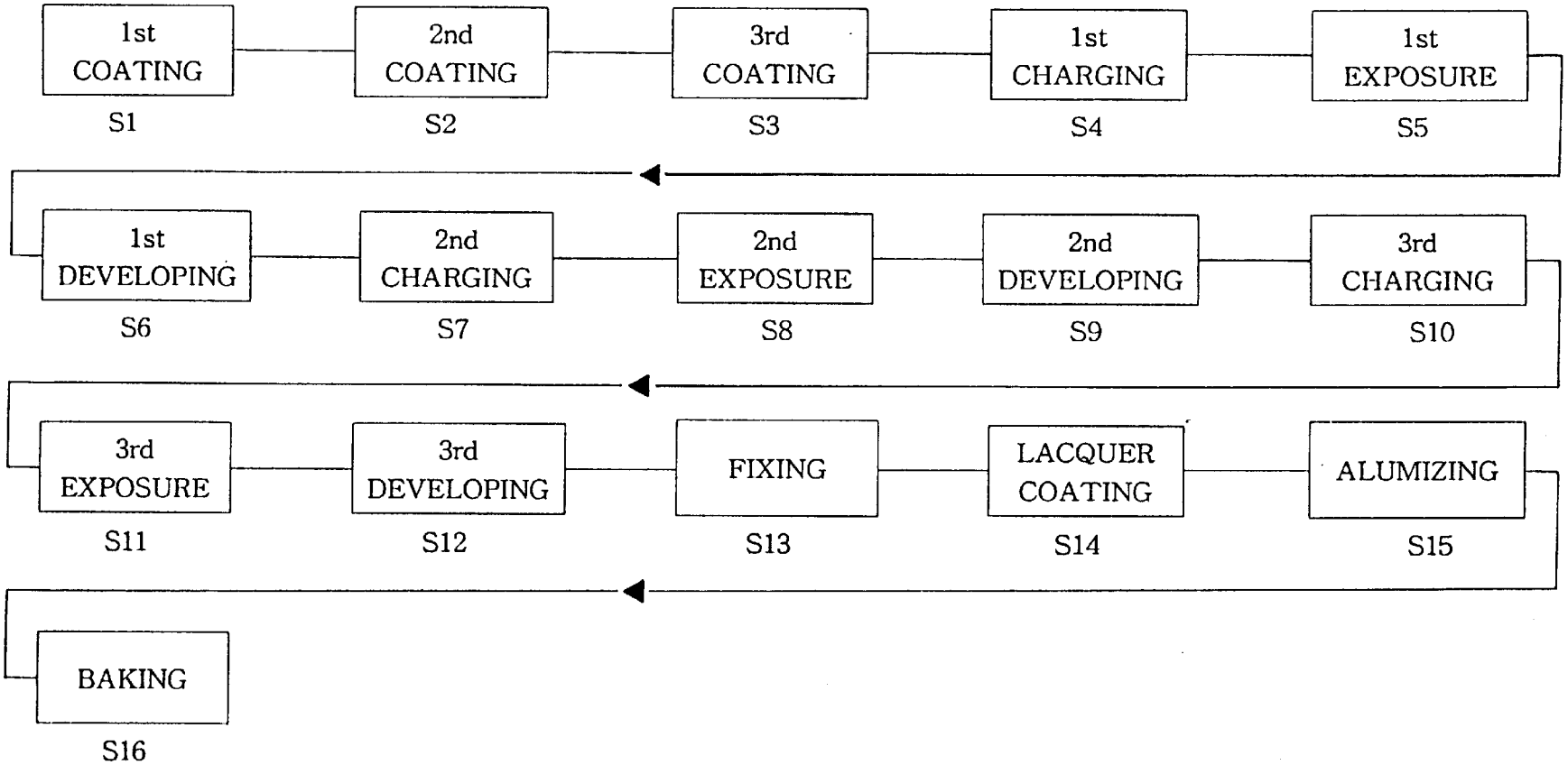
FIG. 6 is a block diagram of the processing sequence for forming an array of three phosphor elements using the steps of FIGS. 5A to 5E.

FIG. 6 is a block diagram of the processing sequence for forming an array of three phosphor elements using the aforementioned steps. In steps S1, S2 and S3, a conductive layer 132, a first photoconductive layer 134 and a second photoconductive layer 136 are sequentially formed as shown in FIG. 5A. Prior to step S1 of the present EPS process, a matrix of light-absorptive material can be formed by the prior photolithographic wet process or by the electrophotographically described in U.S. Pat. No. 4,921,767, cited above. In FIG. 4, the forming sequence of the matrix of light-absorptive material is omitted but can also be formed on the second photoconductive layer 136 through the steps of charging, exposing, developing and fixing as to the dry-powdered, light-absorptive between step S103 and a first charging step S104. An array of three phosphor elements R, G and B are then deposited on the second photoconductive layer 136 of the panel 12 on which the black matrix of light-absorptive material is deposited.

In step S104, the first photoconductive layer 34 is positively charged in the manner described in FIG. SB, and in step S105 the areas of the first photoconductive layer 134 where a first phosphor particles G will be deposited are exposed in the manner described in FIG. 5C. Then, in steps S106, the first phosphor particles G are deposited the exposed areas of the second photoconductive layer 136 in the manner described in FIG. 5D. Between steps S106 and S107, the deposited first phosphor particles G may be fixed on the exposed areas of the second photoconductive layer 136 in the manner described in FIG. 5E.

The steps of charging, exposing and developing are repeated for a second phosphor particles B in steps S107 to S109, and also for the third phosphor particles R in steps S111 to 113. Then, said three deposited phosphor particles R, G and B are fixed in step S114 on the second photoconductive layer 136 in the manner described in FIG. 5E.

Subsequent to the fixing of the three phosphor particles R, G and B, a spray film of lacquer is applied by conventional means to the screen structure materials in step 114 and then a thin film of aluminum is vapor deposited onto the lacquer film in step 115, as is known in the art.

In step 116, the faceplate panel 12 is baked in a conventional manner to drive off the volatilizable constituents of screen including the conductive layer 132, the first and second photoconductive layer 134 and 136, the solvents present in both the screen structure materials and in the filming lacquer.

As an alternative to the above-described "matrix first" process, the black matrix 21 may be electrophotographically formed after the fixing of the three phosphor particles R, G and B in the manner described U.S. Pat. No. 5,240,798, cited above.

The present EPS process using two differently-sensitive, photoconductive layers facilitates the uniform charging over the whole surface of the second photoconductive layer with no need of the complicated discharging apparatus during the charging step as shown in FIG. 5B. Therefore, it is possible to obtain a uniform density in the deposited particles over the whole surface of the second photoconductive layer in the foregoing developing step. Also, the resultant screen assembly manufactured by the present EPS process possesses a uniform density of the screen structure materials.

What is claimed is:

1. A method of electrophotographically manufacturing a luminescent screen on an interior surface of a faceplate panel for a CRT comprising the steps of:

(a) first-coating said surface of the panel with a volatilizable conductive layer;

(b) second-coating said conductive layer with a volatilizable first photoconductive layer including a dye sensitive to ultraviolet rays;

(c) third-coating said ultraviolet-photoconductive layer with a volatilizable second photoconductive layer including a dye sensitive to visible light;

(d) establishing a substantially uniform electrostatic charge over the whole area of the inner surface of said second photoconductive layer by exposing the whole surface of said second photoconductive layer to visible light to charge said first photoconductive layer while applying a suitable DC voltage between the conductive layer and the second photoconductive layer;

(e) exposing selected areas of said second photoconductive layer to ultraviolet rays through a shadow mask to discharge the charge from the selected areas of the inner of the second photoconductive layer through the first photoconductive layer and the conductive layer; and (f) developing one of the charged, unexposed areas and the discharged, exposed areas depending upon the polarity of the charged particles with one of charged phosphor particles and light-absorptive material particles after removing the shadow mask.

2. The method of claim 1, wherein the developing step (f) is performed by spraying one of phosphor particles and light-absorptive material particles toward the second photoconductive layer through a venturi tube and a nozzle from a hopper with suitably charging the one of phosphor particles and light-absorptive material particles by means of a corona discharger.

3. The method of claim 1, wherein the one of charged phosphor particles and light-absorptive material particles is charged first color-emitting phosphor particles, said method additionally comprising the steps:

(g) repeating steps (d), (e) and (f) for charged second and third color-emitting phosphor particles consecutively and respectively, subsequent to the step (f); and (h) fixing said developed three color-emitting phosphor particles to said photoconductive layer to form a luminescent screen comprising picture elements of triads of color-emitting phosphors.

4. The method of claim 3, wherein between the steps (g) and (h), the method includes the additional step of repeating steps (d) and (f) for charged light-absorptive material particles.

5. The method of claim 3, wherein the fixing step (h) is performed by coming into contact with solvent vapour such as acetone, methyl isobutyl ketone, etc., on the surface of the developed second photoconductive layer.

6. The method of claim 1, wherein in the second-coating step (b), said dye sensitive to ultraviolet rays consist of bis dimethyl phenyl diphenyl butatriene, and one of trinitro fluorenone(TNF), ethylanthraquinone(EAQ) and their mixture.

7. The method of claim 1, wherein in the exposing step (e), said ultraviolet rays include visible light.

8. A CRT comprising a luminescent viewing screen and means for selectively exciting areas of said screen to luminescence, wherein said screen is formed by an electrophotographical manufacturing process comprising the steps of:

(a) first-coating said surface of the panel with a volatilizable conductive layer;

(b) second-coating said conductive layer with a volatilizable first photoconductive layer including a dye sensitive to ultraviolet rays;

(c) third-coating said ultraviolet-photoconductive layer with a volatilizable second photoconductive layer including a dye sensitive to visible light;

(d) establishing a substantially uniform electrostatic charge over the whole area of said first photoconductive layer by exposing the whole surface of said second photoconductive layer to visible light to charge said first photoconductive layer while applying a suitable DC voltage between the conductive layer and the second photoconductive layer;

(e) exposing selected areas of said first photoconductive layer to ultraviolet rays through a shadow mask to discharge the charge from the selected areas of the first photoconductive layer;

(f) developing one of the charged, unexposed areas and the discharged, exposed areas depending upon the polarity of the charged particles with one of charged phosphor particles and light-absorptive material particles after removing the shadow mask, the one of charged phosphor particles and light-absorptive material particles is charged first color-emitting phosphor particles;

(g) repeating steps (d), (e) and (f) for charged second and third color-emitting phosphor particles consecutively and respectively, subsequent to the step (f); and (h) fixing said developed three color-emitting phosphor particles to said photoconductive layer to form a luminescent screen comprising picture elements of triads of color-emitting phosphors.

* * * * *